United States Patent [19]

Johansson et al.

[11] 4,146,247

[45] Mar. 27, 1979

[54] SKI BINDING

[75] Inventors: Christer Johansson, Husum; Roger Johansson, Moliden, both of Sweden

[73] Assignee: Aktiebolaget Broderna Kjellstrom, Solna, Sweden

[21] Appl. No.: 827,304

[22] Filed: Aug. 24, 1977

[30] Foreign Application Priority Data

Aug. 30, 1976 [SE] Sweden ..... 7609577

[51] Int. Cl.[2] ..... A63C 9/10

[52] U.S. Cl. ..... 280/615

[58] Field of Search ..... 280/615, 614, 635

[56] References Cited

U.S. PATENT DOCUMENTS

| | | | |
|---|---|---|---|
| 3,874,684 | 4/1975 | Dysthe | 280/615 |
| 4,032,172 | 6/1977 | Pyzel et al. | 280/615 |

FOREIGN PATENT DOCUMENTS

| | | | |
|---|---|---|---|
| 446385 | 6/1927 | Fed. Rep. of Germany | 280/615 |
| 2306721 | 11/1976 | France | 280/615 |
| 119009 | 3/1970 | Norway | 280/615 |
| 83367 | 5/1935 | Sweden | 280/615 |
| 47968 | 12/1909 | Switzerland | 280/615 |
| 166826 | 1/1934 | Switzerland | 280/615 |

*Primary Examiner*—David M. Mitchell

*Attorney, Agent, or Firm*—Eric Y. Munson

[57] ABSTRACT

A ski binding of the toe binding type including a stirrup pivotable between a position, where a ski boot may be inserted into or removed from the binding, and a locking position, where a rear portion of the stirrup engages a hook formed on a forwardly projecting sole portion of the ski boot and/or engages in a slot in the upper face of said sole portion. In the locking position, said sole portion may be pivoted upwardly in the vertical plane together with the rear portion of the stirrup against the bias of a spring element mounted on the binding.

7 Claims, 2 Drawing Figures

SKI BINDING

BACKGROUND OF THE INVENTION

The present invention relates to a ski binding of the toe binder type. This type of binding differs from other known types of binding in that only the ski boot is gripped by means of a binding attached to the ski.

Among earlier known toe bindings there are those with locking portions pivotably mounted in the lugs of the toe fitting, and which are arranged for clamping against the edge of the boot sole, thereby clamping the boot against the substructure, which is provided with upstanding friction - increasing spikes. Ski bindings of this kind have the drawback that the sole is gripped at places where it has simultaneous sideways support from the toe fitting, whereby freedom of movement of the boot is reduced. This also results in persons who do a lot of skiing and use such bindings, competition skiers for example, often have problems with their toes and primarily their big toes.

A ski binding has been put on the market, with the help of which the above drawbacks will be removed. This binding is also of the toe binder type, but distinguishes from previously known bindings in that, inter alia, it does not have locking details which are arranged to be clamped against the edge of the boot sole for clamping the boot against the substructure. With this binding a ski boot must be used which differs from conventional ski boots in that the front edge or forward portion, of the boot sole is extended and provided with a raised protuberance in the form of a so-called hump. In the centre of this hump is a throughgoing hole. In use, the ski boot is placed so that the hole through the hump is placed in line with corresponding holes made in the forward portion of the lugs on the toe fitting. Attachment of the ski boot to the binding and thereby also to the ski is obtained by inserting a locking pin through the hole in one of the lugs of the toe fitting, through the hole in the hump and out through the hole in the other lug of the toe fitting. The pin is secured and locked by a flexible plastic or rubber tongue extending from one end of the pin to a holder placed in the middle of a plate joining both lugs to the toe fitting. This binding has been found to lessen the problem with the skier's toes. However, this binding also has several serious disadvantages. For example, it has been found that the holes in the lugs of the toe fitting, as well as the hole in the hump, become very easily clogged, due to the formation of ice plugs and the entry of gravel particles into the holes, making it impossible to insert the locking pin. Furthermore, the locking pin can be lost, since it is removable from the binding and is not fixedly mounted in all situations. Another disadvantage is that it is almost a necessity to use the bare hand when inserting the locking pin, which is very troublesome in severe cold weather. There is also the risk that the securing material, which is of plastic or rubber, may break off in severe cold weather, which can result in the locking pin slipping out of its position and thereby making continued skiing impossible. Neither has it been unusual for the front portion of the boot sole to break off when using said binding. A contributing cause for this would appear to be that the front edge of the sole is relatively rigidly anchored in the binding.

SUMMARY OF THE INVENTION

The ski binding according to the present invention contemplates a solution of all the above problems. It is both robust and uncomplicated. Under no circumstances is it necessary to use the bare hand when attaching the ski boot to the binding. It is not even necessary for the skier to bend down for this operation, and he can attach the boot solely with the assistance of his ski pole. The binding contains no loose or removably mounted portions which can be lost before, during or after skiing. The binding is not affected by the possible presence of ice plugs and/or grains of gravel. Furthermore, as a result of its construction, e.g. the spring connection between the stirrup and the toe fitting, the binding provides a certain amount of mobility for the front edge of the ski boot sole. This will relieve the stress on the sole sufficiently so as to minimize the risk of breakage. The binding according to the invention is thus both practical and easily manipulated.

BRIEF DESCRIPTION OF THE DRAWINGS

The invention is apparent in more detail from the following description, during the course of which the appended drawing is referred to, where.

DESCRIPTION OF A PREFERRED EMBODIMENT

Figure 1:
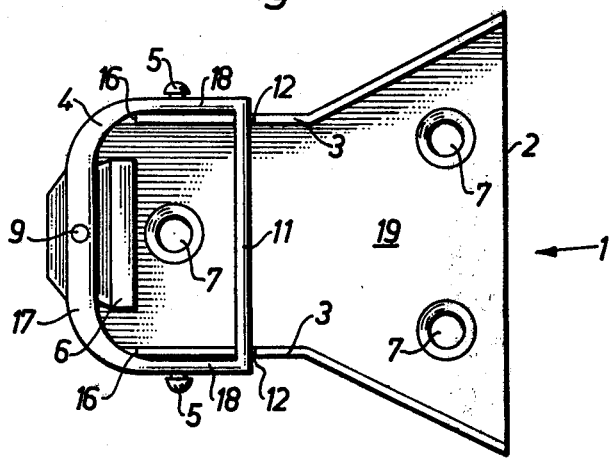
FIG. 1 shows a plan view of an embodiment of the ski binding according to the invention.

The binding 1 consists of a toe fitting 2 having upstanding side plates 3 on each side. A stirrup 4, formed as a closed frame, and with two legs or branches 18 parallel to the ski 8, is pivotably mounted on rivets 5 passing through the legs 18 and attached to the side plates 3 thus forming a pair of levers having rear arms and front arms, respectively. Instead of rivets 5, a pin extending from side plate to side plate can be used for mounting the stirrup, if so desired. The forward end or portion 17 of the stirrup is forced upwards in a direction away from the bottom plate 19 of the toe fitting 2 by means of a spring element 6. The spring element 6 can consist of a leaf spring for example, as shown on the drawing, or of one or more helical springs inserted between the stirrup 4 and the toe plate 2. If helical springs are used, these can be mounted on the pin, extending between the side plates 3 and on which the stirrup 4 is mounted. Holes are countersunk in the bottom plate 19 of the toe fitting 2, to receive screws for mounting the binding 1 to the ski 8. A hole 9 is made in the forward portion 17 of the stirrup 4. This hole is designed to accommodate the tip of the conventional ski pole.

The upper edges of the side plates 3 are recessed to provide notches 12 so that the rear cross bar 11 of the stirrup 4 can be moved into engagement with the forwardly projecting sole extension 13 of the ski boot 10. By pivoting the legs or branches 18 of the stirrup 4 to the outside of the side plates 3, and by the rear portion 11 of the stirrup 4 being inserted into the notches 12 during skiing, a free space is provided between the side plates for the forwardly projecting sole extension 13, while at the same time imparting rigidity to the stirrup frame in the horizontal plane.

Figure 2:
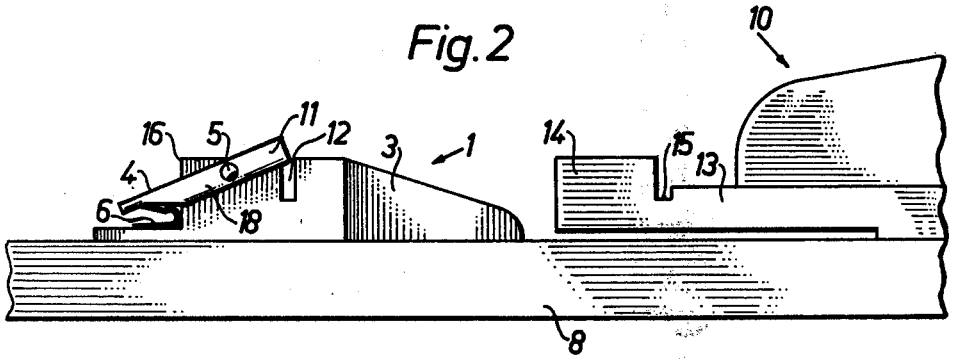
FIG. 2 shows a vertical section of this ski binding (placed on a ski) with associated boot, before the insertion of the boot into the binding

FIG. 2 shows how the binding appears when the ski boot 10 is to be inserted. To make the binding 1 ready for the ski boot, a force is applied, either by hand or by the ski pole against the upper face of the front portion 17 of the stirrup 4, so that the spring element 6 is biased and the rear bar 11 of the stirrup is raised from the notches 12 in the side plates 3 of the toe fitting. The forwardly projecting sole 13 of the ski boot 10 is formed with hook 14 having an engagement recess 15. The sole hook 14 has a configuration and a dimension substantially corresponding to the space in the ski binding between the forward edges 16 on the side plates 3 and the forward edges of the notches 12.

Figure 3:
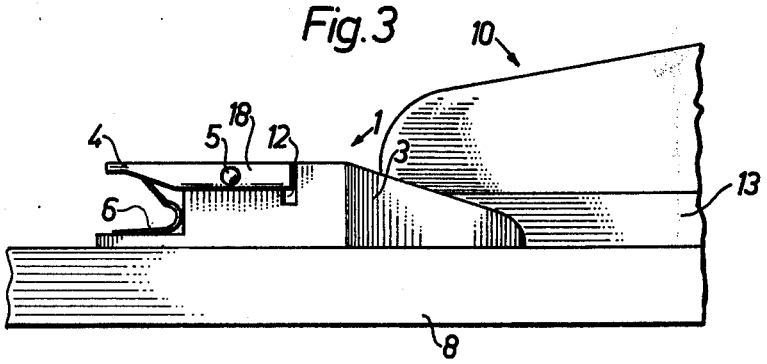
FIG. 3 shows a vertical section of this ski binding with the boot inserted and clamped in the binding.

The appearance of the ski binding 1 after the boot 10 has been inserted in the binding and clamped thereto is apparent from FIG. 3. The boot is inserted into the binding 1 far enough for the forward edge of the sole hook 14 to be aligned with the forward edges 16 of the side plates 3. The engagement recess 15 is then in alignment with the notches 12. The force applied to the upper face of the forward portion 17 of the stirrup 4 is then removed, the recoiling spring element 6 thus causing the cross-bar 11 of the stirrup to move into the notches 12, thereby retaining the sole hook 14 in position. As a result of this clamping of the sole hook 14, and because of the fact that the forward portion of the sole 13 will assume a configuration conforming with that of the binding 1, a fixed and stable anchorage of the ski boot 10 to the binding 1, and consequently to the ski 8, is obtained. The construction of the side plates of the toe fitting shown in FIG. 1, i.e. where the toe fitting is partly trapezoidal and partly rectangular, has been found to give a very stable binding.

The invention is however not limited to such a configuration of the toe fitting. For example, the entire fitting can be substantially trapezoidal in shape. This also results in the stirrup 4 also being substantially trapezoidal. Neither is it necessary that the cross-bar 11 extends along the whole width of the toe fitting 2. For example, the portion 11 can be replaced by two stubs extending from the respective notch 12 to ¼ of the width of the toe fitting. The length and construction of the limbs must, however, always be such that a stable anchorage of the ski boot is obtained. It is furthermore not necessary (even if it is preferred) that the spring element is connected to the stirrup and toe fitting respectively via the forward portion 17 of the stirrup. The same effect can be achieved, for example, by applying springs to the outside of the side plates 3 in the vicinity of the cross-bar 11 of the stirrup.

Neither does the boot 10, fitting the binding according to the invention, need to have the construction shown in FIG. 2. For example, the forward sole portion 13 can be of uniform thickness right to the toe of the boot, and the recess 15 can be replaced by a slot transverse to the sole, with a cross section substantially corresponding to the notches 12.

The side plates 3 in the binding shown in FIG. 1 are perpendicular to the toe fitting plate 2. To still further improve the anchorage of the boot 10 to the binding 1 and primarily counteract the force acting through the sole hook 14 towards the stirrup 4 the side plates 3 can be made so that they form an angle of less than 90° to the toe fitting plate 2. It is preferred that only the lower portion of the side plates, i.e. the portion which is in direct contact with the toe fitting plate 2, forms such an angle. For example, the lower half of the side plates can form an acute angle to the toe fitting plate 2, while the upper half is perpendicular to the toe fitting plate, similarly to what is shown in FIG. 1. This bend in the side plates does not need to extend along their entire length, it being sufficient to restrict the bent portion to the forward portion of the side plates, e.g. where both plates are parallel according to FIG. 1. The forward sole portion 13 on the boot 10 must then also be made in a similar way, since there is a male-female relationship between the boot and the binding.

With regard to the stiffness of the spring element 6, the spring force should be adjusted so that the skier can open the binding without any great exertion, while the force required is sufficient to keep the binding in a closed position during skiing.

It should be understood that the invention is not limited to the embodiments described herein and shown on the drawing, but may find a variety of expressions within the scope of the appended claims.

We claim:

1. In a ski binding in which the toe portion of the sole of the ski boot is inserted and clamped in position between a pair of sole-engaging side plates extending upwardly from a toe fitting anchored to the upper surface of the ski, improved clamping means comprising:

(a) an extension having a transverse recess in the upper surface thereof projecting from the toe portion of the sole of the ski boot a distance to provide flexing of the boot sole in its clamped position;

(b) a notch located in the upper edge of each of said side plates so as to be aligned with the recess in said extension in the inserted position of the sole of the ski boot;

(c) a stirrup frame for clamping the boot sole in position, comprising a pair of side legs, each pivoted to the outside lateral surface of each of said side plates forward of said notch to form a pair of levers having rear arms adapted to engage said aligned notches and recess to lock said extension in the inserted position, and front arms for moving said rear arms into and out of said notches and recess; and (d) spring means on said toe fitting for urging said rear arms into engagement with said notch.

2. A ski binding according to claim 1, in which said rear arms comprise a cross-bar extending between said side legs for engaging said aligned notches and recess.

3. A ski binding according to claim 2, in which said forward arms comprise an interconnecting bridge for engaging said spring means.

4. A ski binding according to claim 1, in which said recess defines a hook portion substantially level with the notched edges of the side plates.

5. A ski binding according to claim 2, in which said recess defines a hook portion substantially level with the notched edges of the side plates.

6. A ski binding according to claim 3, in which said recess defines a hook portion substantially level with the notched edges of the side plates.

7. A ski binding according to claim 6, in which said interconnecting bridge is provided with a hole for engaging the tip of a ski pole to actuate said forward levers.

* * * * *